US008172346B2

(12) United States Patent
Tafoya et al.

(10) Patent No.: US 8,172,346 B2
(45) Date of Patent: May 8, 2012

(54) ARTICULATED SEALING SURFACE

(75) Inventors: Cory Jerome Tafoya, Louisville, KY (US); Bryan W. Snider, Louisville, KY (US); Rebecca Eakins, Louisville, KY (US)

(73) Assignee: General Electric Company, Schenectady, NY (US)

( * ) Notice: Subject to any disclaimer, the term of this patent is extended or adjusted under 35 U.S.C. 154(b) by 229 days.

(21) Appl. No.: 12/508,659

(22) Filed: Jul. 24, 2009

(65) Prior Publication Data

US 2011/0018413 A1 Jan. 27, 2011

(51) Int. Cl.
*A47B 96/04* (2006.01)
*A47B 95/00* (2006.01)
*A47B 96/00* (2006.01)

(52) U.S. Cl. ..... 312/404; 312/330.1; 312/296

(58) Field of Classification Search ..... 312/402, 312/404, 330.1, 29, 296; 277/628–654
See application file for complete search history.

(56) References Cited

U.S. PATENT DOCUMENTS 2,859,495 A * 11/1958 Roberts ..... 49/480.1
3,339,994 A * 9/1967 Reddig et al. ..... 312/301
3,722,975 A * 3/1973 Taylor ..... 312/334.44
4,609,234 A * 9/1986 Naniwa et al. ..... 312/296
4,702,536 A * 10/1987 Kraynak ..... 312/330.1
4,732,435 A * 3/1988 Bailey et al. ..... 312/311
5,641,217 A * 6/1997 Caruso et al. ..... 312/404
5,694,789 A * 12/1997 Do ..... 62/441
6,371,584 B1 * 4/2002 Alreck ..... 312/235.1
7,008,032 B2 * 3/2006 Chekal et al. ..... 312/405
7,350,886 B2 * 4/2008 Antos et al. ..... 312/404
7,712,852 B2 * 5/2010 Choi et al. ..... 312/402
2006/0042299 A1 * 3/2006 Oh et al. ..... 62/348
2006/0049731 A1 * 3/2006 Choi et al. ..... 312/330.1
2010/0090574 A1 * 4/2010 Lim et al. ..... 312/404

* cited by examiner

*Primary Examiner* — Darnell Jayne
*Assistant Examiner* — Andrew Roersma
(74) *Attorney, Agent, or Firm* — Global Patent Operation; Douglas D. Zhang

(57) ABSTRACT

An appliance including a housing have an opening, a drawer having a front side and a back side, the drawer being configured for insertion into the opening, a drawer face coupled to the front side, the drawer face having a gasket circumscribing the drawer face and at least one dimension of the drawer face is smaller than a respective dimension of the opening so as to form a gap between the drawer face and the opening on at least one side of the drawer face, and a transom pivotally mounted to the drawer, the transom being configured to substantially bridge the gap between the drawer face and the opening and sealingly engage the gasket when the drawer is in a closed position.

16 Claims, 8 Drawing Sheets

ARTICULATED SEALING SURFACE

BACKGROUND OF THE INVENTION

The subject matter described herein relates generally to articulated sealing surfaces for appliances.

It is known in the art to provide seals around doors and drawers on, for example, appliances. Generally these seals are magnetic or compression seals that are affixed to the back face of the door or drawer so that the seal contacts the frame or housing of the appliance when the door or drawer is closed. When an appliance such as, for exemplary purposes only, a refrigerator is installed adjacent a cabinet having drawers, it is desirable to have the drawer(s) of the appliance line up with and substantially match the drawers of the cabinetry in size and shape. However manufacturing the drawers of the appliance to substantially match the size and shape of the cabinet drawers typically provides insufficient drawer capacity to be useful to the user of the appliance.

It would be advantageous to have an appliance drawer with a drawer face that substantially matches the drawer faces of adjacent cabinetry in size and shape while providing an increased drawer volume.

BRIEF DESCRIPTION OF THE INVENTION

As described herein, the exemplary embodiments overcome one or more of the above or other disadvantages known in the art.

One aspect of the exemplary embodiments relates to an appliance. The appliance includes a housing having an opening, a drawer, a drawer face and a transom. The drawer has a front side and a back side. The drawer is configured for insertion into the opening. The drawer face is coupled to the front side and has a gasket circumscribing the drawer face. The drawer face has at least one dimension that is smaller than a respective dimension of the opening so as to form a gap between the drawer face and the opening on at least one side of the drawer face. The transom is pivotally mounted to the drawer and is configured to substantially bridge the gap between the drawer face and the opening and sealingly engage the gasket when the drawer is in a closed configuration or position.

Another aspect of the exemplary embodiments relates to a transom for a drawer of an appliance. The appliance has a drawer opening and a drawer disposed within the drawer opening. The drawer has a drawer face such that the drawer opening is larger than the drawer face so that a gap is formed on at least a side of the drawer between the drawer face and the drawer opening. The transom includes a frame pivotally mounted to the drawer and a sealing surface mounted to the frame. When the drawer is in a closed position the transom is configured to substantially bridge the gap between drawer face and the drawer opening for sealing the drawer opening.

Still another aspect of the exemplary embodiments relates to a drawer for an appliance. The drawer has a front side and a back side and is configured for insertion into an opening of the appliance. The drawer includes a drawer face affixed to the front side of the drawer. The drawer face has a gasket circumscribing the front side of the drawer and at least one dimension of the drawer face is smaller than a respective dimension of the opening so as to form a gap between the drawer face and the opening on at least one side of the drawer face. A transom is pivotally mounted to the drawer. The transom configured to substantially bridge the gap between the drawer face and the opening when the drawer is in a closed configuration.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and unless otherwise indicated, they are merely intended to conceptually illustrate the structures and procedures described herein. In addition, any suitable size, shape or type of elements or materials could be used.

DETAILED DESCRIPTION OF THE EXEMPLARY EMBODIMENTS OF THE INVENTION

Figure 1:
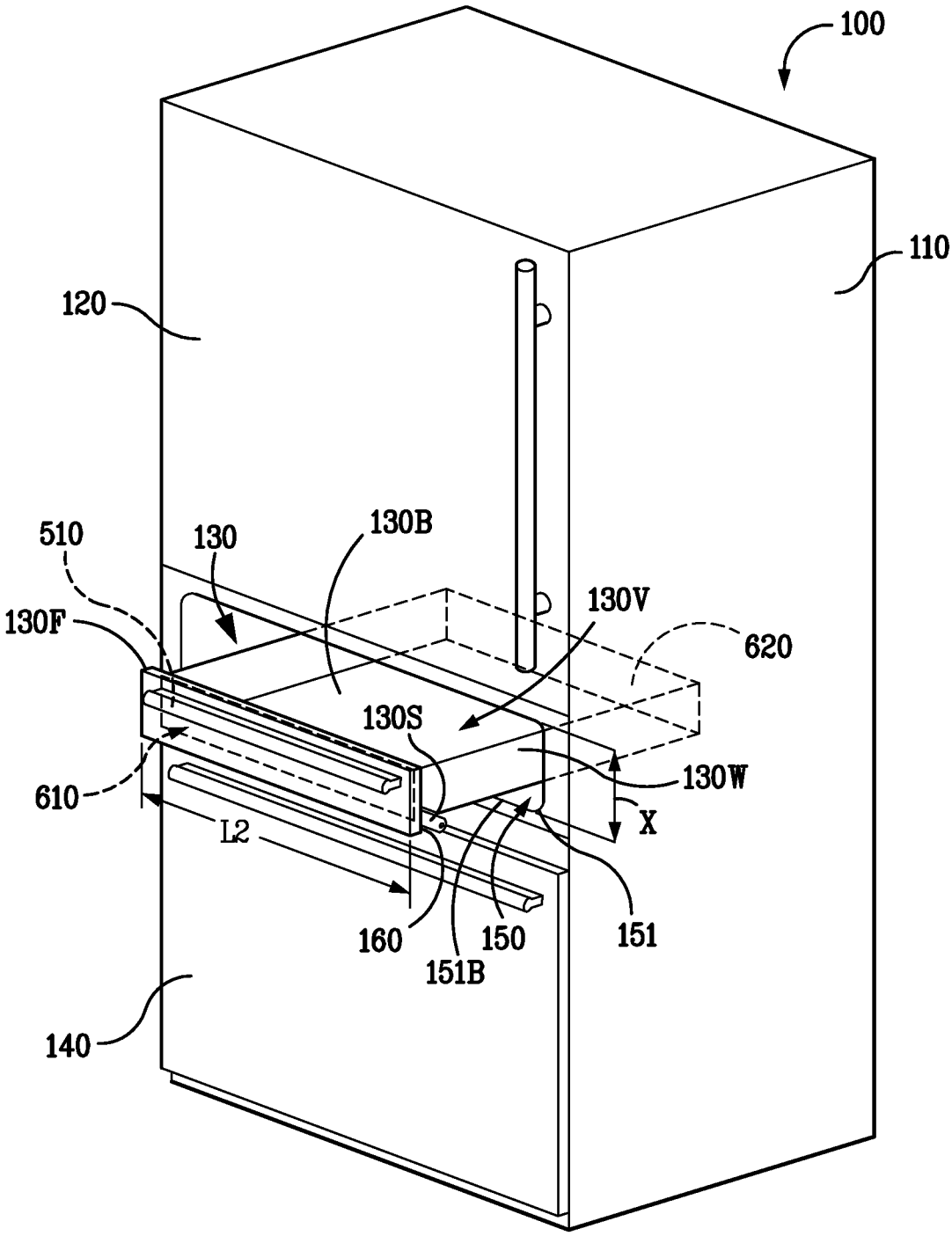
FIG. 1 is a schematic illustration of an exemplary appliance incorporating features in accordance with an exemplary embodiment.

Referring to FIG. 1, one embodiment of an appliance 100 incorporating aspects of the claimed subject matter is illustrated. Although the embodiments disclosed will be described with reference to the drawings, it should be understood that the embodiments disclosed can be embodied in many alternate forms. In addition, any suitable size, shape or type of elements or materials could be used. In the exemplary embodiments described herein the appliance 100 is configured as a refrigerator with a bottom freezer for exemplary purposes only. It should be understood that while the exemplary embodiments are described herein with respect to a refrigerator, the exemplary embodiments may be applied to any suitable appliance having any suitable configuration in a manner substantially similar to that described herein.

The exemplary embodiments provide an appliance having an increased drawer volume while maintaining a drawer face having at least one dimension that substantially matches the faces of adjacent cabinet drawers. For exemplary purposes only, a height of the drawer face may match the height of the drawer faces of adjacent cabinets. The exemplary embodiments provide an articulated sealing surface or transom that allows the drawer opening in the appliance to be larger than the drawer face where the articulated sealing surface is configured to seal the drawer opening in conjunction with the drawer face.

In one exemplary embodiment, the appliance 100 includes a frame or housing 110. The housing 110 forms internal cavities for storing items, such as food and beverages. In this example, the appliance 100 is in the form of a refrigerator having a bottom freezer such that a refrigerator cavity is sealed by door 120 and drawer 140 seals a freezer cavity. In this example, the appliance 100 also includes a third cavity 150 (e.g. refrigerator or freezer) having an opening 151 for inserting drawer 130. In alternate embodiments the appliance 100 may have any suitable configuration. The drawer 130 includes a bottom 130B and walls 130W extending from the bottom to form an internal volume 130V of the drawer 130. The drawer 130 may be mounted within the third cavity 150 in any suitable manner such as with, for exemplary purposes only, tracks or rails that allow the drawer 130 to move into and out of the third cavity 150. A drawer face 130F is mounted to a wall 130W at the front 610 of the drawer 130 such that the perimeter of the drawer face 130F extends outwardly past a perimeter of the front 610 of the drawer 130 so as to form a face sealing surface 160 around the front side 610 of the drawer 130. The face sealing surface 160 includes a suitable gasket 510 (FIG. 4) as described below.

In this example, the drawer 130 includes a transom 130S that is pivotally mounted to, for example, the bottom 130B of the drawer 130. In this application, the term "transom" is not limited to a horizontally disposed member. Rather, it refers to an elongated member that can be disposed in any orientation relative to the ground. In other examples, the transom 130S may be suitably located at any position on the drawer 130 or the housing 110 of the appliance. The transom 130S has a width L1 (FIG. 2) substantially equal to the width L2 of the drawer face 130F so that a suitable seal is formed between the drawer face sealing surface 160 and the transom 130S for sealing the opening 151 of the third cavity 150. It is noted that a height X1 of the transom 130S is configured to substantially fill a gap X3 (FIG. 6B) formed between, in this example, the bottom 601 (FIG. 6B) of the drawer face 130F and/or the lower portion 510L (FIG. 6C) of the gasket 510 and the bottom 151B (FIG. 6B) of the opening 151.

Figure 2:
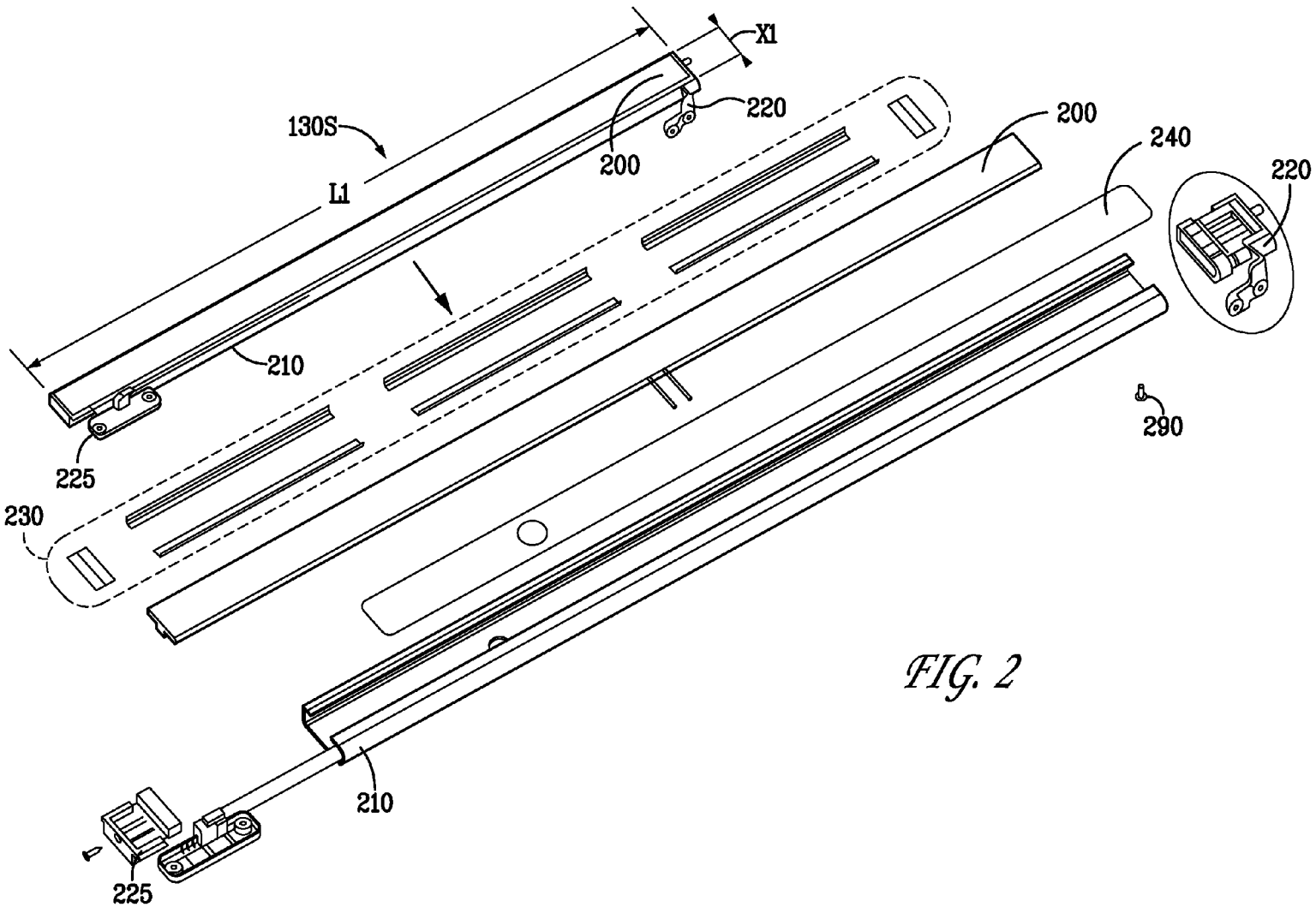
FIGS. 2 through 4 are schematic illustrations of portions of an articulated transom in accordance with an exemplary embodiment.
Figures 3A, 3B:
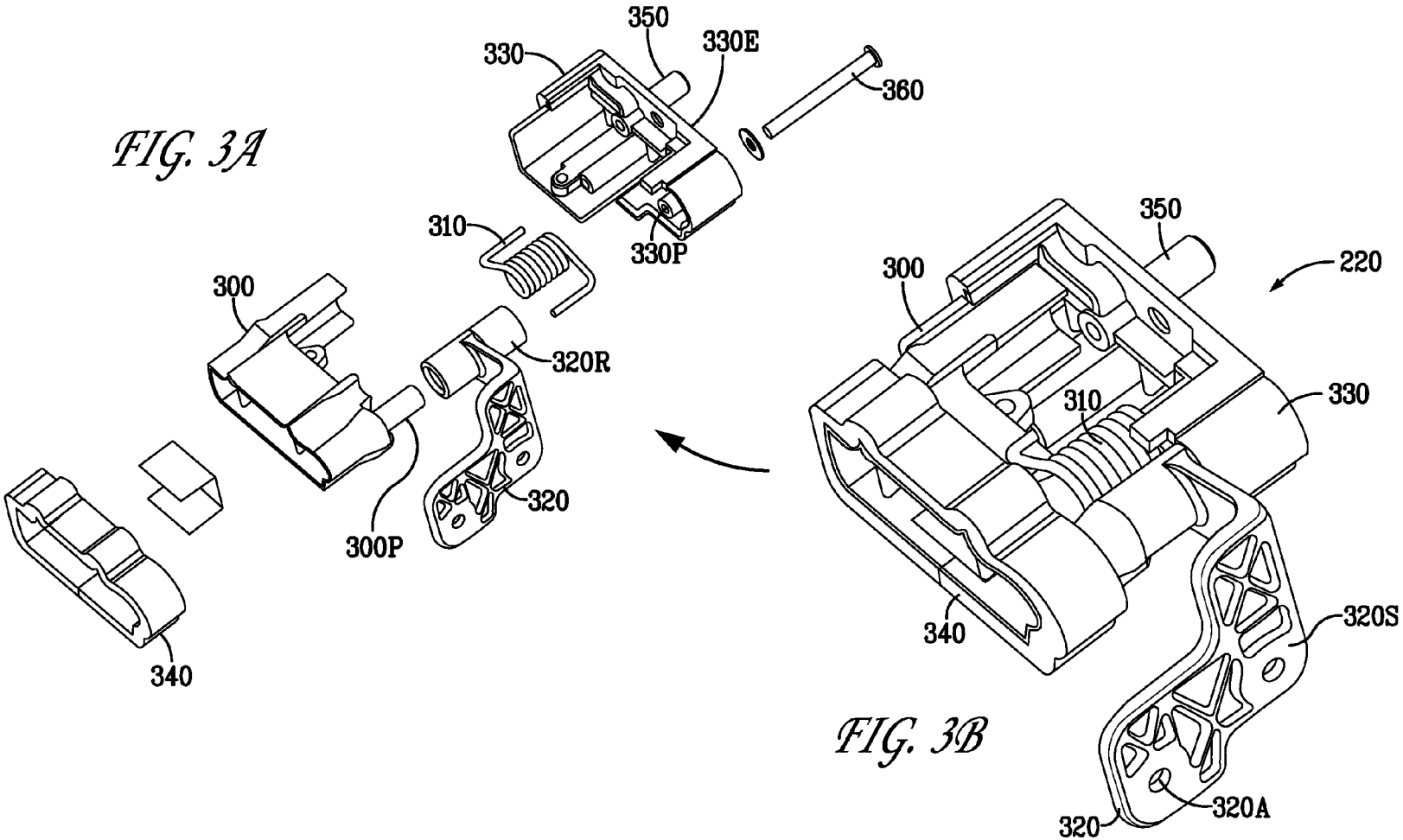
Figure 4:
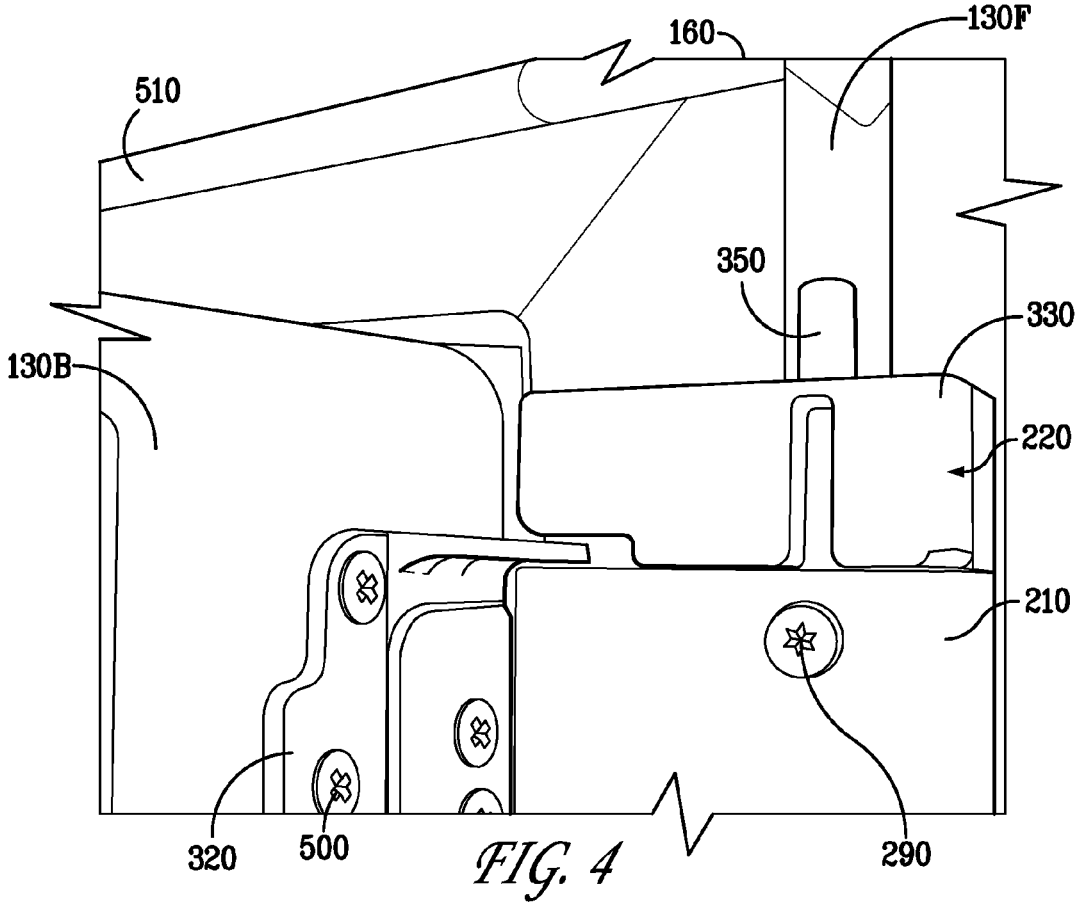

Referring also to FIGS. 2-4, the transom 130S includes a frame 210, hinges 220, 225 and a sealing surface 200. The frame 210 in this example has a substantially C-shaped cross section but in alternate embodiments the frame 210 may have any suitable configuration. The frame 210 is configured so that the transom sealing surface 200 attaches to the open portion of the substantially C-shaped channel in any suitable manner. The transom sealing surface 200 may include a decorative fascia (that e.g. matches a finish on the housing 110) and backing positioned behind the fascia so that suitable gaskets of, for example, the face sealing surface 160 will contact the transom sealing surface 200. In one example, the backing of the transom sealing surface 200 may be a ferrous backing to allow magnetic gaskets on the face sealing surface 160 to adhere to the transom sealing surface 200. The fascia and backing of the sealing surface 200 may be of unitary construction or separate pieces. The transom 130S may also include any suitable seals 230 for providing a seal between the transom 130S and, for example, the housing 110 of the appliance 100. In one example the seals 230 may be disposed on the transom sealing surface 200 or any other suitable surface of the transom 130S that contacts the housing 110. Insulation 240 may be provided within the frame 210 for insulating the environment within the third cavity 150 from an exterior environment when the drawer 130 is in a closed configuration to, for example, mitigate heat loss from the third cavity 150.

In this example, the transom 130S includes two hinges 220, 225 that mount to respective ends of the transom 130S. At least one of the hinges 220, 225 is configured to cause a pivoting of the transom 130S as the drawer 130 is opened and closed in one example, the hinges 220, 225 are substantially similar to each other for allowing the transom 130S to pivot relative to the drawer 130.

In one example, as can be seen best in FIG. 3, hinge 220 includes a hinge body 300, a first hinge cap 330, a second hinge cap 340 and a hinge mount 320. The hinge body 300 includes a hinge pin 300P and the hinge mount 320 includes a hinge pin receiver 320R. The hinge pin receiver 320R is suitably sized so that the hinge pin 300P can be inserted into the hinge pin receiver 320R for hingably mounting the hinge mount 320 to the hinge body 300. The hinge mount 320 includes apertures 320A through which fasteners 500 are inserted for affixing the hinge mount 320 (and the hinge 220) to, for example, the bottom 130B of the drawer 130.

The first hinge cap 330 is configured to fit over and couple to at least a portion of the hinge body 300 in any suitable manner for securing the hinge mount 320 to the hinge body 300. For example, the first hinge cap 330 includes a protrusion 330P that is inserted into the hinge pin receiver 320R such that a fastener 360 is inserted through the protrusion 330P for engaging, for example, the hinge pin 300P. The hinge pin 300P and the protrusion 330P when coupled by the fastener 360 form a stable axis of rotation of the hinge body 300 relative to the hinge mount 320. A biasing spring 310 is positioned within the hinge body 300 and/or the first cap 330 for biasing the hinge body 300 in a predetermined position relative to the hinge mount 320 or drawer. In this example, the biasing spring 310 biases the hinge body 300 such that the transom 130S is held against the bottom 130B of the drawer 130 in a stowed position when the drawer 130 is in an open configuration. In alternate embodiments, the biasing spring 310 may bias the hinge mount 320 (and transom 130S) in any suitable position relative to the drawer 130. The first hinge cap 330 also includes a cam pin 350 extending from an end 330E of first hinge cap 330. The second hinge cap 340 is configured to fit over and couple to the hinge body 300 in any suitable manner. The second hinge cap 340 is configured to substantially conform to the C-shaped cross section of the frame 210 for stably locating the hinge 225 within the frame 210 when the hinge 225 is inserted into the frame 210. The hinge 225 is fastened to the frame 210 in any suitable manner such as with, for example, one or more suitable fasteners 290.

As can be seen best in FIG. 4, the second hinge cap 340 and at least a portion of the hinge body 300 are inserted within the frame 210 so that the first hinge cap 330 substantially abuts an end of the frame 210 allowing the hinge mount 320 to freely pivot between the first hinge cap 330 and the frame 210 or vice versa. As can also be seen in FIG. 4, the cam pin 350 extends longitudinally away from the frame 210.

Figure 5:
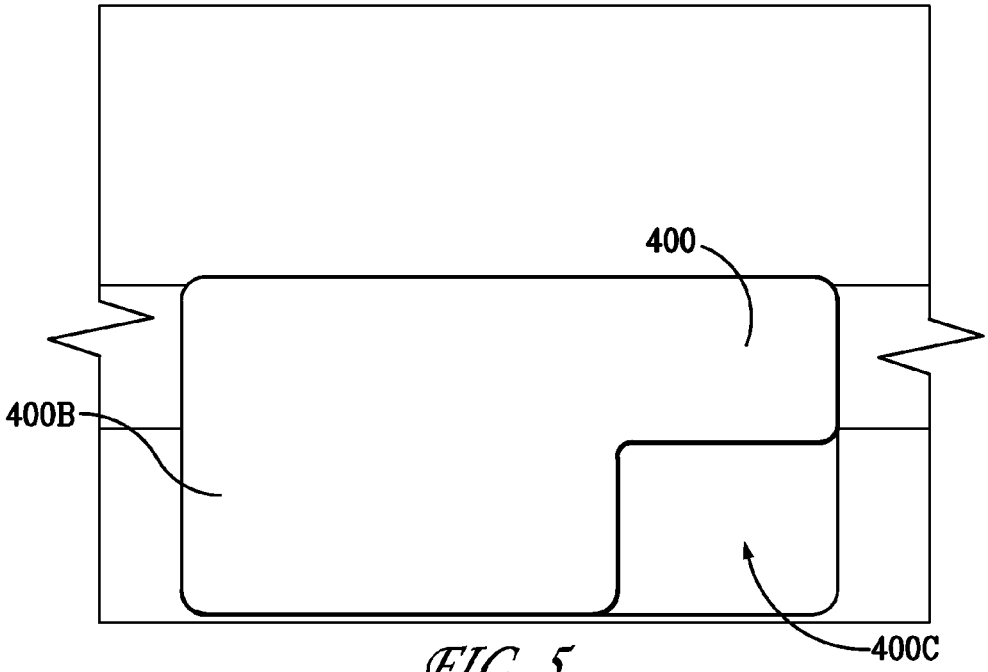
FIG. 5 is a schematic illustration of a guide in accordance with an exemplary embodiment.
Figure 6A:
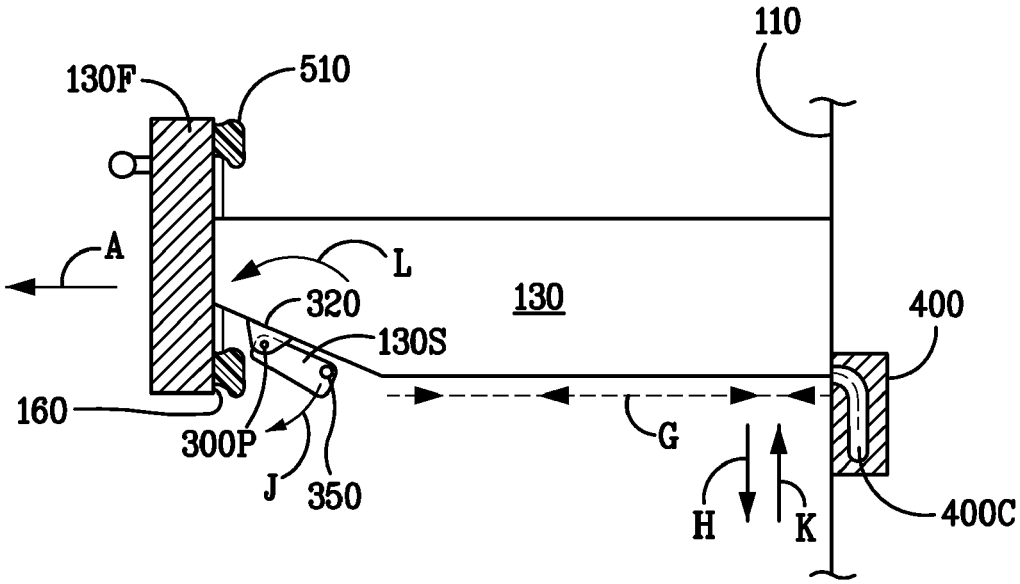
FIGS. 6A through 6C are schematic illustration of a drawer of the appliance in FIG. 1 in open and closed configurations or positions in accordance with an exemplary embodiment.
Figure 6B:
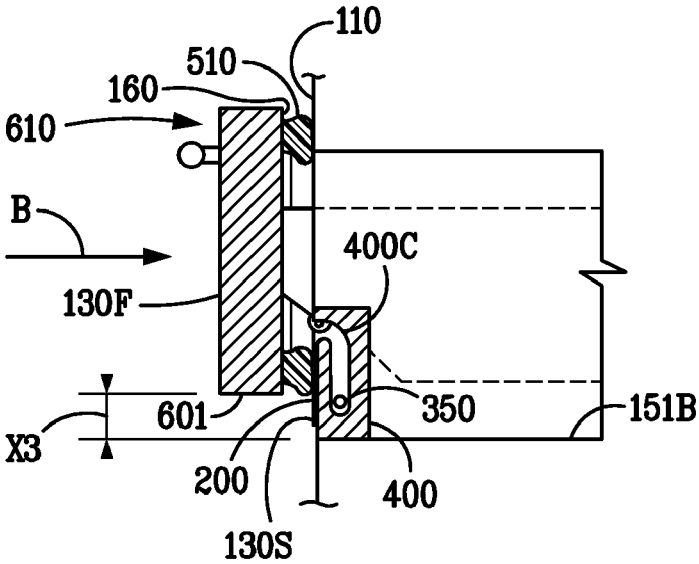

In the embodiment illustrated in FIGS. 5 through 6B, at least one guide 400 is mounted, at least partially within the third cavity 150 for engaging the cam pin 350 of the transom 130S for causing the pivoting of the transom 130B relative to the drawer 130 as the drawer 130 is opened and closed. The guide 400 includes a body 400B having a cam channel 400C formed within the body 400B for guiding the cam pin 350. As the drawer 130 is closed, the movement of the drawer 130 in the direction of arrow B causes the cam pin 350 to travel along the path G and engage the cam channel 400C. When the drawer 130 is closed in the direction of arrow B, the cam channel 400C is configured to guide the cam pin 350 substantially in the direction of arrow B (e.g. in the direction of travel of the drawer 130 as the drawer 130 is closed) and then substantially in the direction of arrow H (e.g. in a direction substantially transverse to the direction of travel of the drawer as the drawer 130 is closed) so that the cam pin 350 substantially follows the path G shown in FIG. 6A and the transom 130S is pivoted about hinge pin 300P in the direction of arrow J from the stowed or open position shown in FIG. 6A (e.g. biased against the bottom of the drawer 130) to a closed position shown in FIG. 6B.

As the drawer 130 is opened in the direction of arrow A, the movement of the drawer 130 in the direction of arrow A causes the cam pin 350 to travel along the path G. The cam channel 400C guides the cam pin 350 substantially in the direction of arrow K (e.g. in a direction substantially transverse to the direction of travel of the drawer as the drawer 130 is opened and closed) and then substantially in the direction of arrow A (e.g. in the direction of travel of the drawer 130 as the drawer 130 is opened) so that the cam pin 350 substantially follows the path G shown in FIG. 6A. The transom 130S is pivoted about hinge pin 300P in the direction of arrow L from an closed position shown in FIG. 6B to the stowed position shown in FIG. 6A.

It should be understood that while in this example only one hinge 220 is shown having the cam pin 350, in other examples both hinges 220, 225 may have cam pins 350 for engaging respective guides 400 for causing the transom 130S to pivot as the drawer 130 is opened and closed.

Figure 6C:
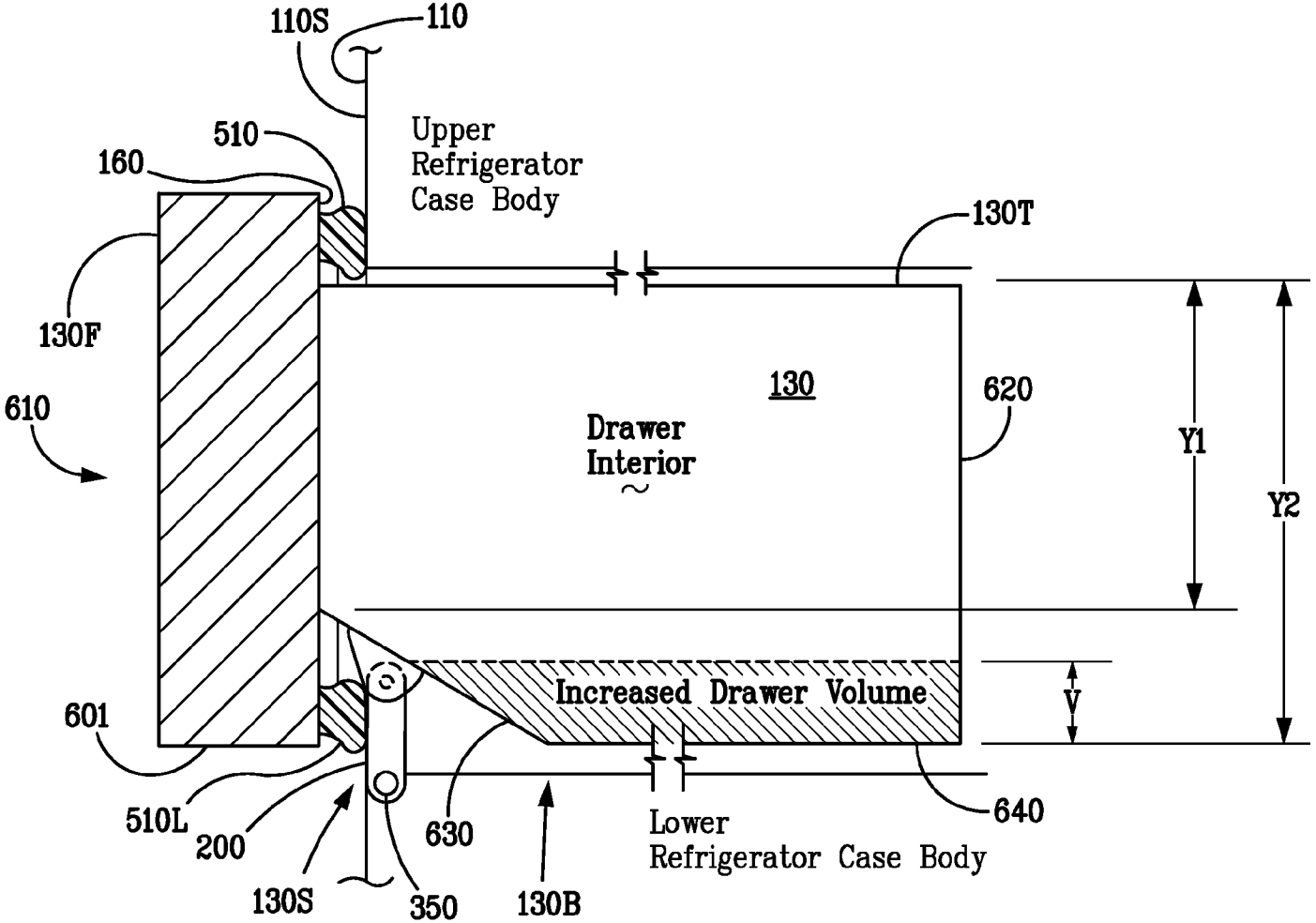
Figure 7A:
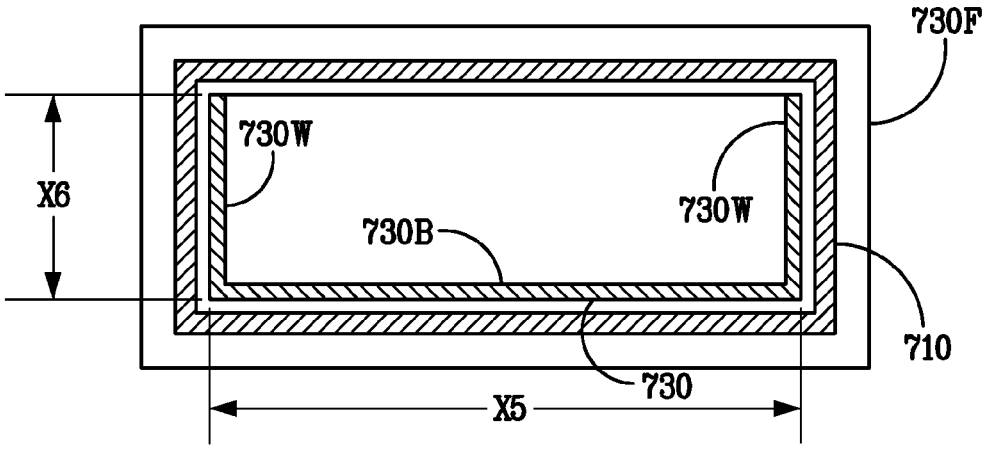
FIG. 7A Prior Art
FIGS. 7A and 7B are schematic illustrations of a conventional appliance drawer in open and closed configurations.
Figure 7B:
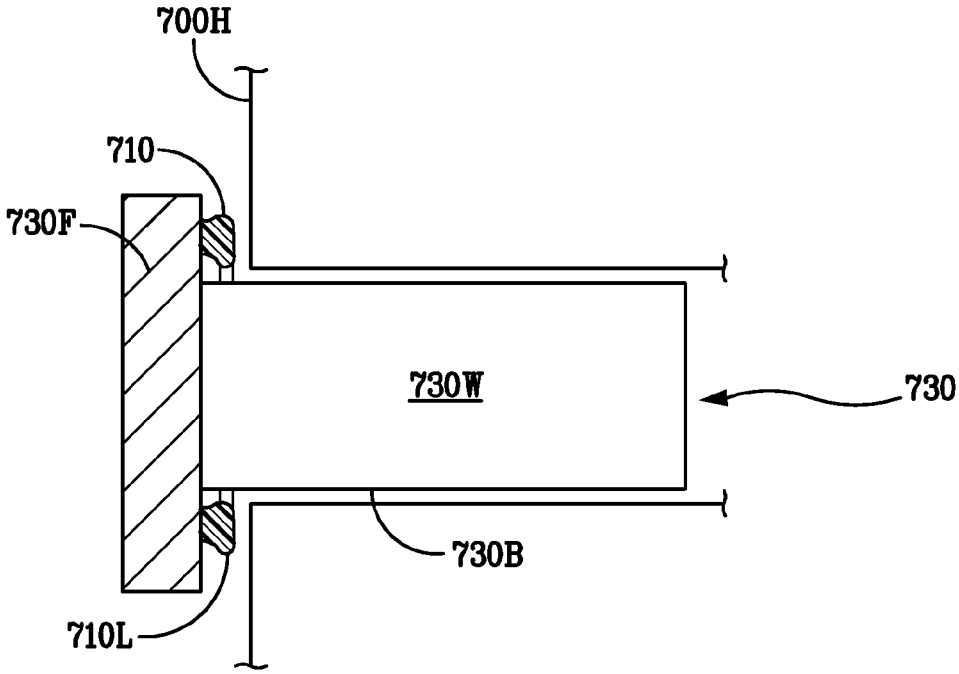
FIG. 7B Prior Art

Referring also to FIG. 6C, as noted above, the face sealing surface 160 of the drawer face 130F includes a gasket 510. The gasket 510 may be any suitable gasket such as, for exemplary purposes only, a magnetic gasket that circumscribes the front side 601 of the drawer 130. The gasket 510 may be configured to releasingly adhere to the sealing surface 200 of the transom 130S as the drawer 130 is closed and the transom 130S is pivoted to the closed position. As can be seen in FIG. 6C, when the transom 130S is in the closed position, the sealing surface 200 is substantially flush with or parallel to the surface 110S of the housing 110 so that the gasket 510 may form a suitable seal with both the housing 110 (e.g. around at least a portion of the perimeter of the opening 151) and the transom 130S. When in the closed position, the transom 130S effectively decreases the height X of the opening 151 for allowing the gasket 510 to seal the third cavity 150 while allowing for an increased volume V to be added to the drawer 130. For example, referring to FIGS. 7A and 7B, with a conventional drawer 730, the walls 730W and the substantially flat bottom 730B of the drawer 730 are bound within the confines of a gasket 710 attached to the drawer face 730F (when viewed from, for example, the back of the drawer 730). For purposes of illustration, the drawer face 730F and the gasket 710 have substantially the same dimensions (e.g. width and height) as the drawer face 130F and gasket 510. With the conventional drawer 730, the bottom 730B of the drawer 730 must be positioned above the lower portion 710L of the gasket 710 so that the gasket 710 can form a seal with the housing 700H of the appliance, leaving the internal volume of the drawer to be dictated by the size (both width and height) of the drawer face 730F and/or gasket 710. In accordance with the exemplary embodiments, as seen in FIG. 6C, the bottom 130B of the drawer extends below or past the bottom 601 of the drawer face 130F and/or lower portion 510L of the gasket 510, providing an increased drawer volume when compared to a second drawer, such as drawer 730, whose width X5 and height X6 are bound by the perimeter of the face 730F and/or gasket 710 of the second drawer where the face 130F and/or gasket 510 of the appliance drawer 130 and the face 730F and/or gasket 710 of the second drawer 730 have substantially the same height and width.

In accordance with the exemplary embodiments, the front side 610 of the drawer 130 is sized (in width and height) to fit within the bounds or perimeter of the gasket 510 such that the front side 610 of the drawer 130 has a first height Y1. The bottom 130B of the drawer 130 includes a first portion 630 and a second portion 640. The second portion 640 is located a distance Y2 from a top 130T of the drawer 130 so that the back side 620 of the drawer 130 has a second height substantially equal to the distance Y2. The first portion 630 of the bottom 130B of the drawer 130 is angled relative to the second portion 640 so as to connect the second portion 640 to the front side 610 of the drawer 130. The first portion 630 is angled such that it extends outwardly and downwardly past the lower portion 510L of the gasket 510 (and/or perimeter of the face 130F) to increase the height of the drawer 130 from the first height Y1 to the second height Y2 to form the increased volume of the drawer 130 when compared to, for example, the conventional drawer 730 shown in FIGS. 7A and 7B. In alternate embodiments, the bottom 130B of the drawer 130 may have any suitable contour for extending outwardly and downwardly past the gasket 510 to allow for the increased volume V of the drawer 130.

Figure 8A:
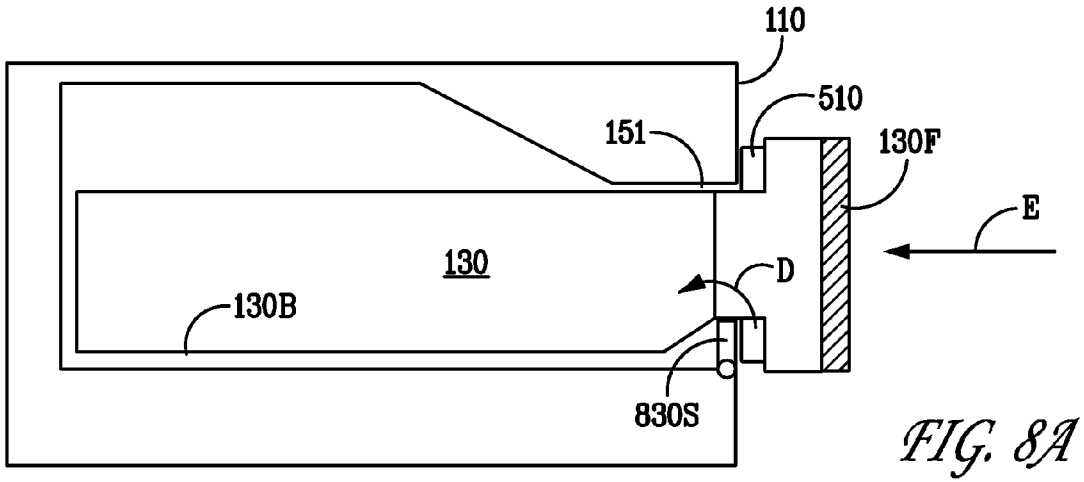
FIGS. 8A and 8B are schematic illustrations of a drawer of the appliance in FIG. 1 in open and closed configurations in accordance with an exemplary embodiment.
Figure 8B:
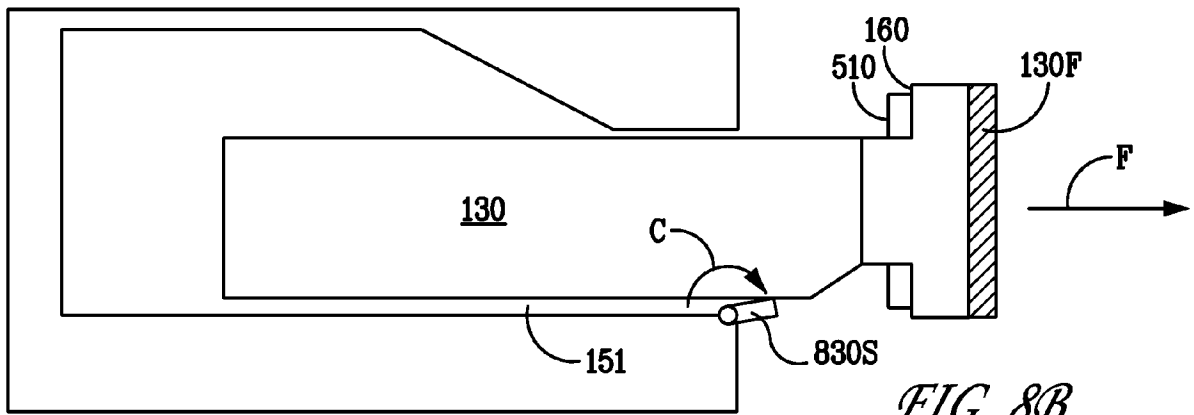

Referring to FIGS. 8A and 8B in another exemplary embodiment, the transom 830S may be mounted to the housing 110 of the appliance 100 rather than to the bottom 130B of the drawer 130. The transom 830S may be mounted adjacent to or at least partially within the opening 151. In this example, the transom 830S may be substantially similar to transom 130S described above. However, in this example, the hinges do not include the cam pin 350 and the biasing spring 310 of the hinges 220, 225 is configured to bias the transom 830S in a closed position as shown in FIG. 8A so that the transom 830S forms a seal with the gasket 510 when the drawer 130 is closed. As the drawer 130 is opened the bottom 130B of the drawer 130 causes the transom 830S to pivot in the direction of arrow C so that the portion of the drawer 130 forming the increased volume is allowed to pass by the transom 830S. It is noted that the contour of the bottom 130B of the drawer 130 is such that the gasket 510 is allowed to clear a path rotation of the transom 830S before the bottom 130B of the drawer 130 causes the pivoting of the transom 830S so as to avoid possible damage to the gasket 510. As the drawer 130 is closed, the contour of the bottom 130B of the drawer 130 allows the transom 830S to pivot in the direction of arrow D for forming a seal with the gasket 510.

It should be understood that while the exemplary embodiments were described herein with respect to the transom being located at the bottom of the drawer, in alternate embodiments the transom may be positioned along one or more lateral sides of the drawer or along the top of the drawer.

Thus, while there have been shown and described and pointed out fundamental novel features of the invention as applied to the exemplary embodiments thereof, it will be understood that various omissions and substitutions and changes in the form and details of devices illustrated, and in their operation, may be made by those skilled in the ad without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An appliance comprising:

a housing have an opening;

a drawer having a front side and a back side, the drawer being configured for insertion into the opening;

a drawer face coupled to the front side, the drawer face comprising a gasket, the gasket comprising a sealing surface circumscribing a surface of the drawer face, at least one dimension of the drawer face being smaller than a respective dimension of the opening so as to form a gap between the drawer face and the opening on at least one side of the drawer face; and a transom pivotally mounted relative to the drawer, the transom being configured to substantially bridge the gap between the drawer face and the opening and sealingly engage the gasket when the drawer is in a closed position, wherein the transom is configured so as to be biased against a bottom of the drawer when the drawer is in an opened position.

2. The appliance of claim 1, wherein the bottom comprises a first portion and a second portion, the first portion being angled relative to the second portion such that the first portion extends outwardly substantially past the sealing surface of the gasket where the front side of the drawer has a first height and the back side of the drawer has a second height, the second height being greater than the first height.

3. The appliance of claim 1, wherein the drawer face comprises a face sealing surface, the gasket being positioned substantially around a perimeter of the face sealing surface and being configured to form a seal between the face sealing surface and both of the transom and at least a portion of a perimeter of the opening.

4. The appliance of claim 1, further comprising at least one guide, the at least one guide being configured to mount at least partially within the opening and cause a pivoting of the transom relative to the drawer.

5. The appliance of claim 1, wherein the transom is pivotally mounted adjacent to or at least partially within the opening, the drawer being configured to contact the transom causing the transom to pivot relative to the drawer as the drawer is opened and closed.

6. The appliance of claim 5, wherein the transom is configured so as to be biased to substantially fill the gap between the drawer face and the opening when the drawer is in the closed position.

7. A transom for a drawer of an appliance, the appliance comprising a drawer opening and a drawer disposed within the drawer opening, the drawer comprising a drawer face such that the drawer opening is larger than the drawer face so that a gap is formed on at least a side of the drawer between the drawer face and the drawer opening, the transom comprising:

a frame pivotally mounted to the drawer; a hinge mounted to the frame, the hinge being configured to pivotally mount the transom relative to the drawer, wherein the hinge comprises a biasing spring, the biasing spring being configured to bias the transom against a bottom of the drawer when the drawer is in an opened position; and a sealing surface mounted to the frame, wherein when the drawer is in a closed position, the transom is configured to substantially bridge the gap between drawer face and the drawer opening.

8. The transom of claim 7, wherein the frame is pivotally mounted relative to a housing of the appliance, wherein the drawer contacts the transom causing the transom to pivot relative to the drawer as the drawer is opened and closed.

9. The transom of claim 7, comprising:

a cam pin extending longitudinally from each end of the frame; and a guide configured to mount to a housing of the appliance and cause a pivoting of the sealing surface relative to the drawer, the guide comprising a cam channel comprising a first surface and a second surface wherein the first surface is configured to pivot the sealing surface to substantially close the gap between the drawer and the drawer opening when the drawer is closed, and the second surface being configured to pivot the sealing surface toward the bottom of the drawer when the drawer is opened.

10. A drawer for an appliance, the drawer comprising a front side and a back side, the drawer being configured for insertion into an opening of the appliance, the drawer comprising:

a drawer face affixed to the front side of the drawer, the drawer face comprising a gasket, the gasket comprising a sealing surface circumscribing a surface of the drawer face, at least one dimension of the drawer face being smaller than a respective dimension of the opening so as to form a gap between the drawer face and the opening on at least one side of the drawer face; and a transom pivotally mounted relative to the drawer, the transom being configured to substantially bridge the gap between the drawer face and the opening when the drawer is in a closed position, wherein the transom is configured so as to be biased against a bottom of the drawer when the drawer is in an opened position.

11. The drawer of claim 10, wherein the bottom comprises a first portion and a second portion, the first portion being angled relative to the second portion such that the first portion extends outwardly substantially past the sealing surface of the gasket where the front side of the drawer has a first height and the back side of the drawer has a second height, the second height being greater than the first height.

12. The drawer of claim 10, wherein the drawer face comprises a face sealing surface, the gasket being positioned substantially around a perimeter of the face sealing surface and being configured to form a seal between the face sealing surface and both the transom and at least a portion of a perimeter of the opening.

13. The drawer of claim 10, further comprising at least one guide, the at least one guide being configured to mount at least partially within the opening and cause a pivoting of the transom relative to the drawer.

14. The drawer of claim 10, wherein the transom is pivotally mounted adjacent to or at least partially within the opening, the drawer being configured to contact the transom causing the transom to pivot relative to the drawer as the drawer is opened and closed.

15. The drawer of claim 14, wherein the transom is configured so as to be biased in a closed position to seal the gap between the drawer face and the opening when the drawer is in the closed position.

16. The appliance of claim 1, wherein the transom is pivotally mounted to the drawer.

* * * * *

UNITED STATES PATENT AND TRADEMARK OFFICE

CERTIFICATE OF CORRECTION

PATENT NO. : 8,172,346 B2
APPLICATION NO. : 12/508659
DATED : May 8, 2012
INVENTOR(S) : Cory Jerome Tafoya et al.

It is certified that error appears in the above-identified patent and that said Letters Patent is hereby corrected as shown below:

In Column 4, Line 1, delete “closed in” and insert -- closed. In --, therefor.

In Column 6, line 52, delete “ad” and insert -- art --, therefor.

In Column 6, Line 67, in Claim 1, delete “have” and insert -- comprising --, therefor.

In Column 7, Line 1, in Claim 1, delete “having” and insert -- comprising --, therefor.

Signed and Sealed this
Fourteenth Day of August, 2012

David J. Kappos

David J. Kappos
*Director of the United States Patent and Trademark Office*